US009279585B2

(12) United States Patent
Zachay

(10) Patent No.: US 9,279,585 B2
(45) Date of Patent: Mar. 8, 2016

(54) CLEANING APPARATUS FOR A CONVECTIVE SECTION OF A THERMAL POWER PLANT

(75) Inventor: Richard Zachay, Voerde (DE)

(73) Assignee: Clyde Bergemann GmbH Maschinen-Und Apparatebau, Wesel (DE)

( * ) Notice: Subject to any disclaimer, the term of this patent is extended or adjusted under 35 U.S.C. 154(b) by 830 days.

(21) Appl. No.: 13/554,234

(22) Filed: Jul. 20, 2012

(65) Prior Publication Data

US 2013/0019897 A1 Jan. 24, 2013

(30) Foreign Application Priority Data

Jul. 20, 2011 (DE) ..... 10 2011 110 926

(51) Int. Cl.

| | |
|---|---|
| ***B08B 3/00*** | (2006.01) |
| ***F23J 3/02*** | (2006.01) |
| ***F23G 5/46*** | (2006.01) |
| ***F28G 1/16*** | (2006.01) |

(52) U.S. Cl.

CPC . *F23J 3/023* (2013.01); *F23G 5/46* (2013.01); *F28G 1/166* (2013.01)

(58) Field of Classification Search

None

See application file for complete search history.

(56) References Cited

U.S. PATENT DOCUMENTS 5,416,946 A 5/1995 Brown et al.

FOREIGN PATENT DOCUMENTS

| | | | |
|---|---|---|---|
| DE | 1451535 | A1 * | 2/1969 |
| DE | 102008060887 | A1 | 9/2008 |
| EP | 1918667 | A1 | 5/2008 |
| GB | 421378 | A | 12/1934 |
| WO | 2010066610 | A1 | 6/2010 |
| WO | 2010091342 | A2 | 8/2010 |

OTHER PUBLICATIONS

EPO machine translation of DE 1451535 retrieved Jul. 27, 2015.*

* cited by examiner

*Primary Examiner* — Eric Golightly
(74) *Attorney, Agent, or Firm* — BainwoodHuang

(57) ABSTRACT

A cleaning apparatus includes at least a holder, a lance with a fluid distributing device, a drive unit for a translatory movement of the lance in the holder, a first fluid conducting system with a first feed, a first return and at least one first flow path proceeding from the first feed toward the first return for cooling the cleaning apparatus, and a second fluid conducting system with a second feed and at least one second flow path proceeding from the second feed toward the fluid distributing device.

6 Claims, 2 Drawing Sheets

CLEANING APPARATUS FOR A CONVECTIVE SECTION OF A THERMAL POWER PLANT

FOREIGN PRIORITY CLAIM

This Patent Application claims priority to German Patent Application No. 10 2011 110 926.2 filed on Jul. 20, 2011, entitled, "CLEANING APPARATUS FOR A CONVECTIVE SECTION OF A THERMAL POWER PLANT", the contents and teachings of which are hereby incorporated by reference in their entirety.

FIELD OF THE INVENTION

The invention relates to a cleaning apparatus for cleaning heating surfaces in the interior of a thermal power plant, in particular in a so-called convective section of the thermal power plant. The invention is used, in particular, in the case of thermal power plants such as a refuse incinerator plant, a substitute fuel plant or a biomass combustion plant. These regularly have many heating surfaces (in particular in the convective section) which are brought into contact with the flue gas from the combustion in the combustion chamber of the thermal power plant. The temperature of the flue gas is lowered by means of the convective heating surfaces and at the same time the energy output from the flue gas in the form of heat is transferred to a cooling medium circuit. The heating surfaces are provided in particular with spaced-apart heat exchanger tubes in the manner of sets and/or in the manner of a top surface for the wall of the thermal plant, in particular in the form of a so-called super-heater, evaporator and/or economizer.

In such thermal power plants, the flue gas carries a plenty of combustion residues, which are deposited in particular on the convective heating surface due to their contact with the convective heating surface. Precisely in the case of the aforementioned fuels and the temperatures present in each case, solid and/or highly viscous residue can be formed on the heating surfaces. The residue covering the heating surfaces reduces the transfer of heat from the flue gas toward the cooling medium and consequently reduces the efficiency of such a thermal power plant. In addition, it must be taken into consideration that the residue also reduces the freely traversable cross section of the thermal power plant, as a result of which an unwanted increase in the flow resistance and/or increased corrosion can take place.

To clean such heating surfaces, the use of, for example, so-called soot blowers along with mechanical tappers is known. Soot blowers are used for the purpose of emitting a flow of a blast medium (selected in dependence on the site of application), such as for instance steam, air and/or water, onto heat exchanger surfaces of thermal power plants. The soot blowers are actuated periodically during the operation of the thermal power plant in order to clean the heating surfaces to restore the desired operating characteristics. Such soot blowers usually have a lance tube which is connected to a pressurized blast medium source. The soot blower also includes at least one distributing device realized as a nozzle, out of which the blast medium is discharged in the form of a stream or jet. In a retractable soot blower, the lance tube is periodically run into the interior of the thermal power plant and withdrawn out of it when, or rather as the blast medium is discharged out of the nozzles. In a stationary soot blower, the lance tube assumes a stationary position in the thermal power plant and is turned periodically whilst the blast medium is discharged out of the nozzles. In each case, the impulse action of the discharged blast medium generates a temperature shock and a mechanical shock on the residue which has accumulated on the heating surface and this is meant to release the residue. Reference is made here to WO-A2010/091342, the contents and teachings of which are incorporated by reference in their entirety, as an example of such a soot blower.

Steam has been normally used up to now to clean the convective section of the thermal power plant. In the case of thermal power plants which have been operated, for example with coal, the steam has been removed from the cooling circuit upstream of the turbine and made available to the soot blowers. The use of fuels with lower calorific value, such as for example refuse or biomass, has resulted in the production of less or substandard steam, such that, in this case, steam with sufficient kinetic energy can no longer be provided on the heating surface. In addition, the steam is in part very moist, which could result in increased corrosion. In addition, it has been ascertained that precisely in the case of the fuels, residues which are very difficult to remove and which bake like cement during treatment with steam are formed on the heating surfaces and, as a result, within a few weeks of the thermal plant being in operation, have lead to the situation where a mechanical cleaning process has to be carried out with the thermal power plant shut down.

Over and above this, trials were undertaken to treat the residue with water even in the region of the convective section of a thermal power plant. In this connection, however, it was deemed to be a problem that it is not possible to ensure that the water is still present in fluid form when the feed speed is low over a blast path of, for example, in excess of 5 meters. Rather, the water finally became vaporous before it was discharged onto the heating surface, which is comprehensible in the case of the temperatures of up to 1000° C. prevailing there and the small quantity of approximately 0.4 l/sec. In addition, it was equally necessary to find a way to counter the expected increased risk of corrosion as a result of the addition of fluid.

The technical difficulties were overcome in part by a cleaning apparatus as is described in WO-A-2010/066610. Even if the apparatus has already proven its worth in use, improvements have been attempted. In particular, the cost expenditure and/or programming expenditure should be reduced further and/or the cooling capacity should be improved.

SUMMARY

Proceeding from here, it is the object of the present invention to solve the problems depicted with reference to the prior art at least in part. In particular, a cleaning apparatus is to be provided which is designed in a structurally simple manner and is operable with low expenditure on control engineering. At the same time, the cleaning of a convective section of a thermal power plant is to be realized in a particularly cautious and effective manner during the operation of the thermal power plant.

The objects are achieved with a cleaning apparatus and a method for cleaning heating surfaces of a convective section of a thermal power plant as disclosed herein. Further advantageous developments of the invention are respectively disclosed herein as well. It must be pointed out that the features stated individually herein can be combined together in an arbitrary, technologically reasonable manner and show further embodiments of the invention. The description, in particular, in conjunction with the figures, explains the invention and provides additional example embodiments.

The cleaning apparatus includes at least:

a holder, a lance with a fluid distributing device, a drive unit for a translatory movement of the lance in the holder, a first fluid conducting system with a first feed, a first return and at least one first flow path proceeding from the first feed toward the first return for cooling the cleaning apparatus, and a second fluid conducting system with a second feed and at least one second flow path proceeding from the second feed toward the fluid distributing device.

The cleaning apparatus is constructed in particular in the manner of a soot blower, a lance-type screw soot blower or the like. A holder, which can be realized in the manner of a framework, a carrying system with/or without a housing or the like, is provided in particular for this purpose. A lance with the fluid distributing device is then held or guided in the holder at a spacing from the ground. The lance is constructed substantially from metal and is tube-like, both the fluid used for cooling and the fluid used for cleaning preferably being supplied at a rear end. The fluids traverse the lance proceeding from the first feed (for the cooling) and from the second feed (for the cleaning). The fluid for cleaning is discharged, matching demand, via the second fluid conducting system by means of the fluid distributing device on the opposite end. The fluid distributing device can be designed as an opening, as a nozzle or in another way. In principle, the lance can also realize several openings or nozzles for discharging the fluid. The fluid for cooling flows through the lance and back again to the first return by means of the first fluid conducting system.

A drive unit for a translatory movement (linear movement, axial movement) of the lance in the holder is also fastened on the holder in a preferred manner. The drive unit, for example a motor, serves, in particular, for the purpose of displacing or moving the lance as a unit or a part region thereof in relation to the holder. In principle, it is also possible for several drives for different movements or, however, one drive for several movements (axial and/or rotational) to be provided. Accordingly, the holder also serves, in particular, as guide and support for the lance in the different movement phases.

On account of the separation of the fluid conducting systems, for cleaning the heating surfaces on the one hand and cooling the cleaning apparatus on the other hand, a more cost-efficient operation of the cleaning apparatus can be achieved compared to cleaning apparatuses which have one single fluid conducting system. On the one hand it is possible to dispense with a metering unit which removes the quantity of fluid necessary for cleaning out of the quantity provided for cooling. In a corresponding manner, it is also possible to dispense with a costly monitoring means which had to readjust the quantity of fluid for cooling, in each case in dependence on the quantity removed for cleaning. In addition, a closed circuit for a first fluid supply system can be provided, by means of which the first fluid conducting system is supplied with fluid exclusively for cooling. The fluid usually has to be prepared especially, so that no deposits and correspondingly blockages are created in the first fluid conducting system. Such deposits or blockages can (after a fairly long operation) lead to damage and/or faulty operation of the cleaning apparatus, because a sufficient cooling is then, where applicable, no longer ensured. The special preparation of the fluid of the first fluid conducting system is consequently more cost-efficient because no fluid for cleaning the heating surfaces is removed from the (now closed) circuit. In a corresponding manner, more cost-efficient industrial water can be used as fluid for cleaning the heating surfaces for the second fluid conducting system, that is to say a fluid without any special preparation. The fluid for cleaning is provided by a second fluid supply system and is conveyed by the second fluid conducting system from the second feed to the fluid distributing device. However, it must be noted that the first fluid conducting system and the second fluid conducting system can also be supplied with fluid by one (single) common fluid supply system. This also means in particular that the common fluid supply system includes the first fluid supply system and the second fluid supply system.

The cleaning apparatus is now realized with a first fluid conducting system which realizes one or several first flow paths in the interior of the lance. A first flow path is now designed, for example, in the manner that the fluid coming from the first feed flows into the lance, traverses the lance in a translatory manner parallel to the axis and finally leaves it again via the first return in the opposite direction of flow. The cleaning apparatus is additionally realized with a second fluid conducting system which has one or more second flow paths in the interior of the lance. The second flow path is designed, for example, such that the fluid for cleaning the heating surfaces reaches the lance by means of the second feed, traverses the lance and leaves the lance by means of the fluid distributing device. In particular, only the two different first flow paths and second flow paths are realized in the lance. Even if it can be advantageous, on occasion, to divide up the flow paths in each case (into several flow paths extending in parallel), as a rule it is certainly sufficient to form one single first flow path and one single second flow path with the lance.

The embodiment of the cleaning apparatus now makes it possible for the lance (in the active phase) to be traversed for cooling continually with (cold) water or another suitable fluid during the operation of the cleaning apparatus by means of the at least one first flow path. When running the lance into the thermal power plant right through the wall, the lance is exposed to the hot surrounding conditions. The water traversing the lance forms an internal cooling circuit for the lance and ensures that the water located therein is present in fluid form even in the case of a fairly long travel path or a fairly long dwell time. Consequently, the lance of the cleaning apparatus can be run, for example, in excess of 5 m or even 10 m into the internal regions of the thermal power plant before the fluid for cleaning is finally discharged by means of the at least one second flow path without the water located in the lance (in the first flow path and/or in the second flow path) is evaporated. Only when the lance or the fluid distributing device is aligned precisely with respect to the desired heating surface, the second fluid conducting system is actuated by means of an operating means such that the fluid for cleaning can be discharged by means of the second feed and the fluid distributing device, in particular immediately within a few seconds.

According to a further development of the cleaning apparatus, the at least one first flow path and at least one second flow path are formed with concentric tubes which are movable at least in part with respect to one another. In particular, the cleaning apparatus is constructed such that both the first feed system (from the first feed towards a surrounding region) and the first return system (from the surrounding region towards the first return) are formed in each case with two sealed tubes which are displaceable toward one another in a telescopic manner (inner tube/outer tube). Thus it is quite particularly preferred that the lance realizes a first outer feed tube on the outside which finally provides the boundary to the environment. The first outer feed tube is supported fluid-tight on (/in) a first inner feed tube. The drive unit now effects, that the first outer feed tube is displaced on (/in) the first inner feed tube in a translatory or axial manner, such that the length of run of the in-flowing fluid first of all flows along the first outer (first inner) feed tube and then also the first inner (first outer) feed tube via the first feed on the inner sheath surface. In this way, the fluid, proceeding from the first feed, can flow as far as up to the opposite surrounding region. The surrounding region surrounds the tip of the lance with the fluid distributing device at least in part. Proceeding from the first feed, the fluid for cooling flows into the surrounding region, is deflected there and continues flowing to the first return, in a preferred manner therefore in the opposite direction to the part of the first flow path which extends from the first feed toward the surrounding region.

In particular, the at least one first flow path is realized therefore in the manner of a counter current heat exchanger.

In a preferred manner, the first flow path is defined inward by two sealed return tubes which are displaceable toward one another in a telescopic manner. An outer (inner) return tube is fastened, for example, to the first outer (first inner) feed tube (or outer return tube to the first inner feed tube, etc.) in the vicinity of the fluid distributing device such that the tube is also moved during the axial movement. The outer return tube, in this case, is also positioned in a fluid-tight manner on the outside (/inside) on the inner return tube. The effect of the drive unit is now, in particular, that with the displacement of the first outer feed tube along (/in) the first inner feed tube, the outer return tube is displaced equally along (/in) the inner return tube in a telescopic manner. As a result, the configuration of the first flow path can be realized structurally in a very simple manner with the tube system.

In addition, in a preferred manner at least one second outer feed tube and one second inner feed tube are provided forming the at least one second flow path. In a preferred manner, the fluid distributing device, which is arranged in particular on the second outer or second inner feed tube, is connected to the first inner feed tube or first outer feed tube such that at least one of the second feed tubes is also moved with the axial movement and consequently the second feed tubes are displaced toward one another in a telescopic manner. In a preferred manner, the tubes are supported against one another by means of guides.

In particular, the at least one first flow path is arranged on the outside in relation to the at least one second flow path. Consequently, in operation, the cooling means forms, in a preferred manner, a type of "double cooling sheath" about the second flow path with the cleaning means.

According to a further advantageous development, at least one non-return valve, with a maximum operating pressure of 1.5 bar, in particular a maximum of 1 bar, is arranged in the at least one second flow path. By means of the low operating pressure, low admission pressures can also be used in the second fluid supply system for the actuation of the second fluid conducting system. The non-return valve closes the at least one second flow path from the second feed toward the fluid distributing device. The non-return valve is actuated and opened by a corresponding pressure between the second fluid supply system and the non-return valve. An operating means regulates the pressure. In particular, at least one frequency-regulated pump control means is provided as the operating means.

In particular, a throttle can also be provided in place of the non-return valve. The throttle is constructed technically in an even simpler manner, and with regard to the high temperatures, where applicable, is even less susceptible to faults, and e.g. is realized in the form of a tube constriction. The throttle is developed, in particular, in the form of a cross sectional flow constriction for the fluid. It is not traversed until a certain pressure level is present in the region between the second feed and the throttle.

The cleaning apparatus with the holder is, in particular, mounted on the outside adjacent to the wall of the thermal power plant. The first and second feed enter the cleaning apparatus and the first return emerges from the cleaning apparatus at a rear end such that they are arranged at a good distance from and are easily reachable by the thermal power plant. Operating means can then be positioned here therefore for a manual operation and/or an automatic operation, by way of which operating means the different first and second flow paths can be supplied with fluid in the interior of the lance, matching demand.

It is particularly advantageous when the cleaning apparatus has a path correcting device. The path correcting device is, in particular, a positioning device, by way of which the cleaning apparatus is pivotable, in particular in a vertical manner, for the at least partial compensation of a deflexion of a self-supporting section of the cleaning apparatus, in particular of a self-supporting section of a cleaning apparatus inside a thermal power plant. In other words, this means that the cleaning apparatus is pivotable in particular in a vertical manner by means of the path correcting device in relation to an (imaginary) horizontal plane such that a deflexion of a self-supporting section of the cleaning apparatus is reduced in relation to the (imaginary) horizontal plane.

In addition, it is deemed to be advantageous that a plurality of the cleaning apparatuses described here according to the invention in the case of a thermal power plant are provided with a convective section, a first fluid supply system and a second fluid supply system as well as a control means for the sequential operation of the cleaning apparatuses being provided. In a preferred manner, the thermal power plant, in this case, is one of the following thermal plants: a refuse incinerator, a substitute fuel combustion plant or a biomass combustion plant. In particular, one single first fluid supply system and/or one single second fluid supply system is provided for all the cleaning apparatuses provided. A control means provided for the operation of all the cleaning apparatuses realizes the sequential operation of the cleaning apparatuses during the operation of the thermal power plant in particular in the manner that, in each case, only one cleaning apparatus is run actively into the convective section and cleans there in a targeted manner. The control means also serves, in particular, for the purpose of acting on the operating means for the connection, where required, of the first feed to the first return or of the second feed to the fluid distributing device in the case of each cleaning apparatus. For this purpose, it is also possible for the control means to have recourse, in particular, to measured values recorded by sensors, information regarding contamination of the heating surfaces etc.

In addition, it is deemed to be advantageous that the convective section of the thermal power plant has spaced-apart heat exchanger tubes and the cleaning apparatuses can be moved into the convective section in a translatory manner through a wall of the thermal power plant, such that the fluid distributing device of the lance reaches the spaced-apart heat exchanger tubes. This means, in particular, that the part region of the lance which forms the fluid distributing device is positioned in the immediate vicinity of the heat exchanger tubes to be cleaned. If no cleaning is to take place, the lance is situated outside the thermal power plant. For cleaning, the lance is then introduced through a corresponding hatch in the wall of the thermal power plant and is inserted into the inner regions of the thermal power plant over a displacement path of, for example, up to 5 m or even up to 10 m. In this way, the fluid distributing device of the lance can be positioned, for example, below or next to the heat exchanger tubes to be cleaned in the interior of the thermal power plant.

According to a further aspect of the invention, a method for cleaning heating surfaces of a convective section of a thermal power plant having spaced-apart heat exchanger tubes is proposed using a cleaning apparatus according to the invention here, fluid being discharged intermittently between the spaced-apart heat exchanger tubes. This means in other words that the cleaning apparatus, where the cleaning fluid emerges regularly in a jet spray pattern radially with respect to the lance, is run into the inner regions of the thermal power plant or of the convective section such that the fluid jet (substantially) is only discharged between the spaced-apart heat exchanger tubes. In particular, direct exposure of the heat exchanger tubes to the supplying pressure of the fluid is to be avoided. The operating means can now be used for the purpose of adjusting the pressure or the reach of the discharged fluid jet for cleaning the heating surfaces. In particular, pressures of 1 bar to, for example, 10 bar are adjusted in a targeted manner. Whereas the lance in this case is no longer moved axially, it is possible additionally to carry out a (limited) rotation, such that, for example, blast angles within the range of, for example, 60° are realized, where applicable with different fluid pressures.

A method where the fluid coming from a first feed flows at least in one section in the manner of a sheath current in the lance as far as up to a surrounding region of the fluid distributing device and inside the sheath flow back to the first return, is also deemed to be advantageous. In the case of the realization of the first fluid conducting system in the interior of the lance, the achievement is that the cold fluid coming from the first feed contacts and consequently cools the outer tubes of the lance. The cylindrical flow in the manner of a sheath is maintained in a preferred manner over the entire length of the lance as far as up to a surrounding region of the fluid distributing device during all operating phases of the cleaning apparatus. Proceeding from the surrounding region, the fluid then flows inside the sheath flow back again to the first return. It is quite particularly preferred for a type of concentric double sheath to be formed with the fluid for cooling, the double sheath surrounding the fluid for cleaning at least in part.

In addition, it is also advantageous when a deflexion of a self-supporting region of the cleaning apparatus is compensated. This means, in particular, that compensation for the deflexion of the self-supporting region of the cleaning apparatus is effected in dependence on the length of the self-supporting region of the cleaning apparatus, in particular by pivoting the cleaning apparatus (vertically). In particular, compensating for the deflexion of the self-supporting region of the cleaning apparatus makes it possible in an advantageous manner to guide a fluid distributing device of the cleaning apparatus in a (extensively) horizontal plane substantially independently of the length of the self-supporting region of the cleaning apparatus. Reference is made here additionally to the above statements concerning the path correcting device.

The features of the apparatuses and methods emerging here as according to the invention can be combined together. In particular, the method according to the invention can be realized with an apparatus according to the invention and/or the apparatus according to the invention can be set up to accomplish the method according to the invention. In this respect, the advantages and effects discussed in each case in this connection are also applicable in a corresponding manner to the other aspect of the invention.

BRIEF DESCRIPTION OF THE DRAWINGS

The invention and the technical associations are explained below in more detail by way of the figures. It must be pointed out that the figures show particularly preferred configuration variants of the invention; however, the invention is not limited to these. Schematic representations are shown, in which.

DETAILED DESCRIPTION

Figure 1:
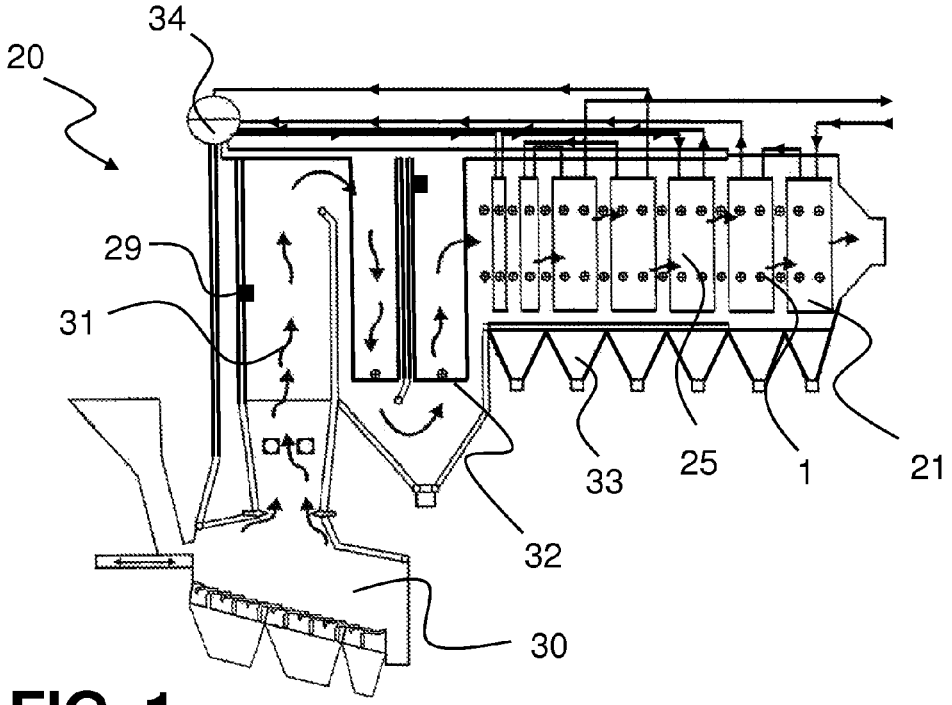
FIG. 1: shows a configuration of a thermal power plant.

FIG. 1 shows a thermal power plant 20, for example for refuse incineration or biomass combustion. Shown at the bottom on the left, in this case, is the combustion chamber 30, in which the refuse or the biomass is combusted. The flue gas created at the same time flows in the direction of flow 31 initially through a series of empty passes 32. In this case, sets of spaced-apart heat exchanger tubes can also be provided on the walls of the combustion chamber 30 or of the empty passes 32 such that a first heat exchange is realized here. In addition, sensors 29 can also be provided here, by way of which the slagging and/or status parameters of the flue gas can be detected.

Once it has traversed the empty passes 32, the flue gas reaches the so-called convective section 21. Many heating surfaces 25, arranged in the manner of sets, projecting into or suspended in the cross sectional flow, are arranged here and are flowed around and/or traversed by the flue gas. The heating surfaces 25 are connected to a cooling medium circuit 34 such that the cooling medium traversing the heating surfaces 25 is heated by the contact of the flue gas. The steam created at the same time serves for producing power, for example by the steam being guided through a corresponding turbine.

A plurality of cleaning apparatuses 1 is provided in this case to clean the heating surfaces 25, for example in the manner of so-called soot blowers, by way of which the slag or residue is removed from the heating surfaces 25 such that it falls, for example, into funnels 33 arranged below where it can be removed if necessary.

Figure 2:
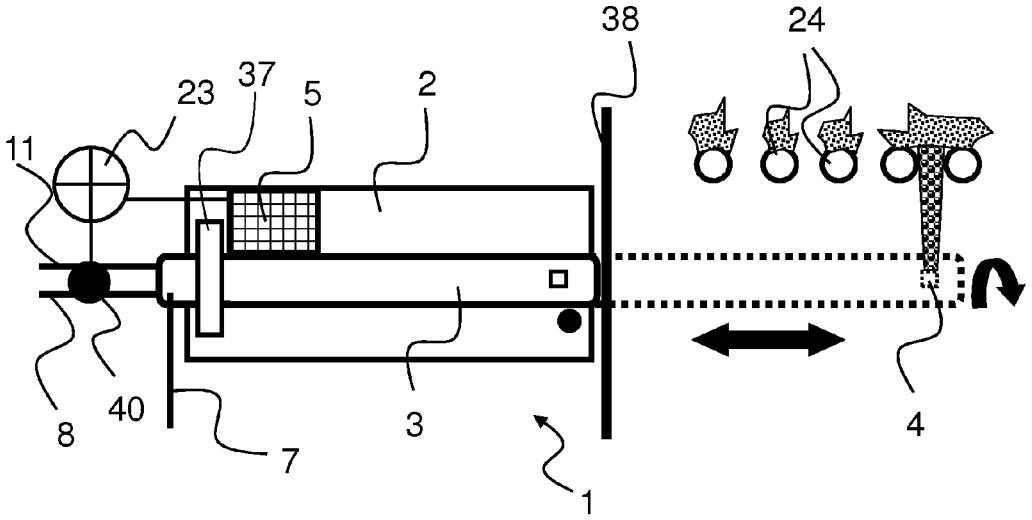
FIG. 2: shows a configuration of a cleaning apparatus.

It is precisely for the cleaning of the heating surfaces 25 in the region of the convective section 21 of the thermal power plant 20 that a cleaning apparatus 1, as shown in FIG. 2, can be provided. The cleaning apparatus 1, in this case, includes a holder 2, for example in the manner of a frame which is realized with steel girders or the like and, if necessary, a housing. The holder 2 serves for the fixing or the supporting of the lance 3 and of a drive unit 5, in this case in the manner of a motor. By way of the drive unit 5, the lance 3 is moved in an axial or translatory manner in relation to the holder 2, such that the lance 3 is moved through the wall 38 of the thermal power plant into the inner region. This is also indicated here on the right in FIG. 2. In addition to the translatory movement, the lance 3, where applicable, can also carry out a rotational pivoting movement such that the fluid discharged by means of the fluid distributing device 4 can be inserted, for example, between spaced-apart heat exchanger tubes 24 and frees the spaces from residues or slagging. In addition, the cleaning apparatus 1 has a path correcting device 37, by way of which the cleaning apparatus 1 can be pivoted in a vertical manner. The path correcting device 37 is realized in a preferred manner as a spindle drive which moves the end of the lance 3, which is situated in the vicinity of the first feed 7 (in particular in the case of a flexible one), downward when the fluid distributing device 4 is inserted further into the interior of the thermal power plant, such that a) the fluid distributing device 4 remains substantially on the same horizontal and/or b) the discharged fluid jet extends substantially (only) in a vertical manner.

The rear region of the cleaning apparatus 1 opposite the fluid distributing device 4 is formed, for example, by a fixed first feed 7 and first return 8 for the fluid for cooling and by a second feed 11 for the fluid for cleaning. Tubes and/or hoses are considered in particular for this purpose. The first feed 7 is, for example, connected to a first fluid supply system such that in this case the fluid (in particular water) where required, e.g. as soon as the lance 3 is to be moved into the thermal plant, is able to flow into the lance 3. An operating means (or operator) 40, which is actuatable in a targeted manner by means of a control means (or controller) 23 for example, is then provided in the or on the first return 8 also at the rear end. The control means 23, which in this case is also responsible for the operation of the drive unit 5 along with the actuation of the operating means 40, can be realized in a separate manner for each cleaning apparatus 1; however, it is also possible for the control means 23 to actuate several cleaning apparatuses 1 and/or operating means 40. The operating means 40 is set up additionally for controlling the pressure at the second feed 11 such that the volume flow in the second fluid conducting system can be controlled thereby.

Figure 3:
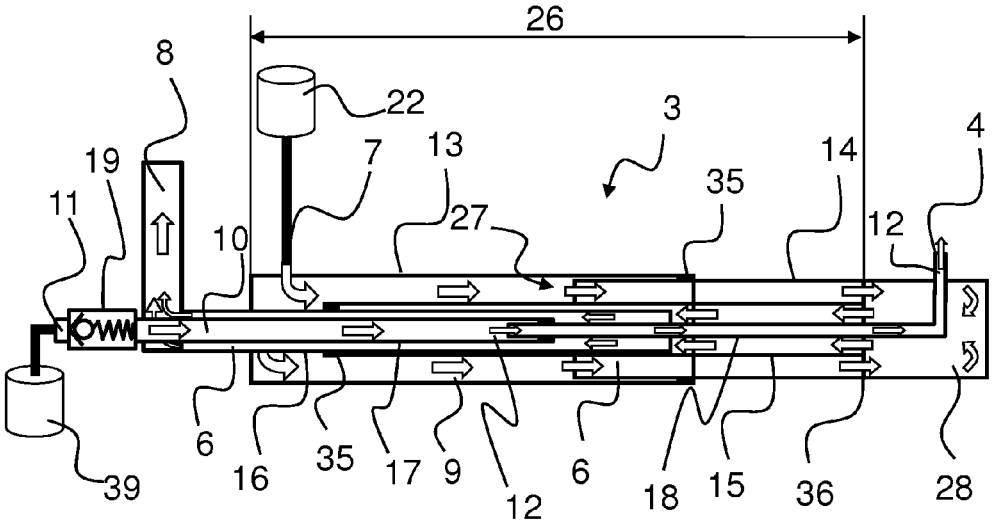
FIG. 3: shows a configuration of a cleaning apparatus in detail.

FIG. 3 now shows a particularly simple construction of such a cleaning apparatus 1 (in this case essentially only part of the lance 3), where a first fluid conducting system 6 is realized with a first feed 7 and a first return 8, wherein a first flow path 9 being set up proceeding from the first feed 7 via a surrounding region 28 toward the first return 8.

FIG. 3 shows the lance 3 driven in a partially telescopic manner, the fluid flowing in from the first fluid supply system 22 via the first feed 7 and leaving the lance 3 finally again via the first return 8. Consequently, it is clear that the fluid is only used for cooling the lance 3. The fluid, in this case, flows via the first feed 7 into a cylindrical annular chamber which is defined between the first outer feed tube 13 and the first inner feed tube 14 on the one hand and the outer return tube 15 and the inner return tube 16 on the other hand. In this case, a type of sheath flow 27 is formed with the fluid such that the outer circumference of the lance 3 is contacted by the cool fluid flow. Between the first outer feed tube 13 and the first inner feed tube 14 there is provided a seal 35 which avoids the fluid escaping in a reliable manner. Such a seal 35 is also provided between the inner return tube 16 and the outer return tube 15.

At an end-side region of the outer return tube 15 opposite the first return 8 there is provided a guide 36, by way of which the outer return tube 15 is positioned concentrically with respect to the first inner feed tube 14. The guide 36 can be developed additionally such that the outer return tube 15 is fixed on the first inner feed tube 14, and is therefore moved at the same time as the inner feed tube. The guide 36 can be realized in the manner of a perforated annular disc. In the region of the lance tip and in particular in the surrounding region 28 of the fluid distributing device 4, the flow is deflected in the manner that the sheath flow 27 collapses and there is an internal recirculation. Just a little in the direction of the first return 8, the fluid then enters into the returns tubes 15, 16 and is directed to the first return 8.

A second outer feed tube 17 and a second inner feed tube 18, which are also sealed off by means of seals 35 and are guided by means of guides 36, are arranged inside the return tubes 15, 16. In this case, the second inner feed tube 18 can be fixed on the first inner feed tube 14 by means of the outer return tube 15 such that at the same time it is moved with the first inner feed tube. The second inner feed tube 18 and the second outer feed tube 17 guide the fluid for cleaning from the second fluid supply system 39 via the second feed 11 and the non-return valve 19 toward the fluid distributing device 4. They consequently form the second flow path 12 and the second fluid conducting system 10.

A sheath flow 27 is generated over the section 26 by the corresponding arrangement of the first flow path 9 and the second flow path 12.

Figure 4:
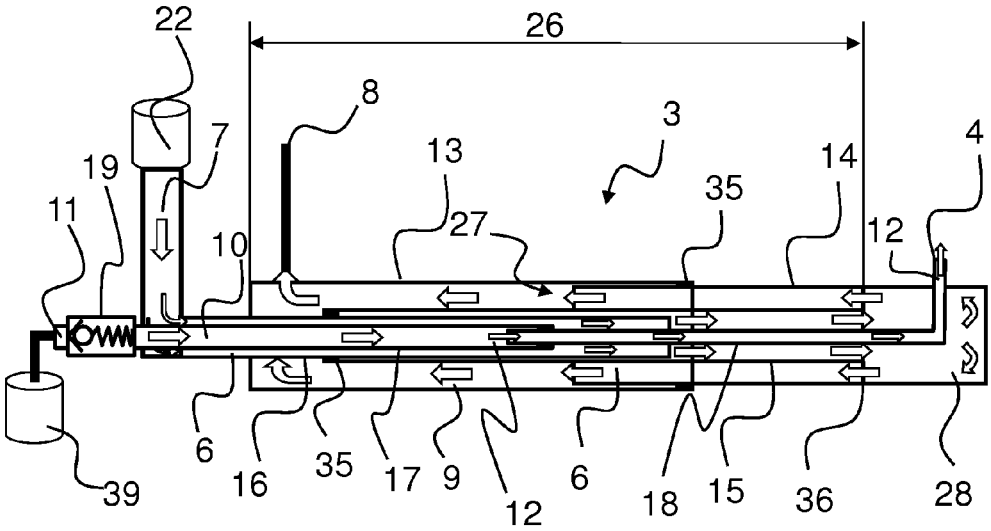
FIG. 4: shows a further configuration of a cleaning apparatus in detail.

It could obviously also be possible in the present example embodiment for the direction of flow of the fluid of the first fluid conducting system 6 indicated by the arrows to run in an opposite direction, when the first fluid supply system 22 and the first feed 7 with the first return 8 are converted in a corresponding manner. Such a configuration of a cleaning apparatus 1 is shown in FIG. 4 which does not differ otherwise from the configuration of the cleaning apparatus 1 according to FIG. 3. Consequently, the description of FIG. 3 is to be used in a corresponding manner for the description of FIG. 4.

The described variants of a cleaning apparatus for cleaning convective heating surfaces are particularly suitable for thermal power plants which are operated with refuse or biomass, a very simple and effective design of the cleaning apparatuses being realized. Using the water cleaning of such heating surfaces targeted here, it is clearly possible to lengthen the operation interval of such thermal power plants. In addition, regulating the pressure at which the fluid is added allows an addition to be adapted to the type of residue or slagging, such that along with simple wetting also abrasive (high pressure) processing and/or simple quenching of the combustion residue can be achieved.

LIST OF REFERENCES

1 Cleaning apparatus
2 Holder
3 Lance
4 Fluid distributing device
5 Drive unit
6 First fluid conducting system
7 First feed
8 First return
9 First flow path
10 Second fluid conducting system
11 Second feed
12 Second flow path
13 Tube (first outer feed tube)
14 Tube (first inner feed tube)
15 Tube (outer return tube)
16 Tube (inner return tube)
17 Tube (second outer feed tube)
18 Tube (second inner feed tube)
19 Non-return valve
20 Thermal power plant
21 Convective section
22 First fluid supply system
23 Control means
24 Heat exchanging tube
25 Heating surface
26 Section
27 Sheath flow
28 Surrounding region
29 Sensor
30 Combustion chamber
31 Direction of flow
32 Empty pass
33 Funnel
34 Cooling medium circuit

35 Seal
36 Guide
37 Path correcting device
38 Wall
39 Second fluid supply system
40 Operating means

The invention claimed is:

1. Cleaning apparatus including at least:

a holder, a lance with a fluid distributing device, a first outer feed tube, a first inner feed tube, an outer return tube, an inner return tube, a second outer feed tube and a second inner feed tube, wherein the lance is drivable in a partially telescopic manner, a drive unit for a translatory movement of the lance in the holder, a first fluid conducting system with a first feed, a first return and at least one first flow path proceeding from the first feed toward the first return for cooling the cleaning apparatus, wherein a fluid can flow from the first feed via the at least one first flow path into a cylindrical annular chamber, which is defined between the first outer feed tube and the first inner feed tube on the one hand and the outer return tube and the inner return tube on the other hand, to a lance tip of the lance, wherein the fluid is deflectable in the lance tip such that the fluid enters the outer return tube and inner return tube and is directed to the first return, a second fluid conducting system with a second feed and at least one second flow path proceeding from the second feed through the second outer feed tube and the second inner feed tube toward the fluid distributing device, wherein the second outer feed tube and the second inner feed tube are arranged inside of the outer return tube and the inner return tube, and a guide, which is provided at an end-side region of the outer return tube opposite the first return and which positions the outer return tube concentrically with respect to the first inner feed tube, wherein the outer return tube is fixed on the first inner feed tube by the guide such that the outer return tube is movable at the same time as the inner feed tube, and wherein in the second inner feed tube is fixed on the first inner feed tube by the outer return tube such that the second inner feed tube is movable at the same time with the first inner feed tube.

2. Cleaning apparatus according to claim 1, where the at least one first flow path and the at least one second flow path are formed with concentric tubes which are movable at least in part with respect to one another.

3. Cleaning apparatus according to claim 1, where the at least one first flow path is realized in the manner of a counter current heat exchanger.

4. Cleaning apparatus according to claim 1, where the at least one first flow path is arranged on the outside in relation to the at least one second flow path.

5. Cleaning apparatus according to claim 1, where at least one non-return valve, with a maximum operating pressure of 1.5 bar, is arranged in the at least one second flow path.

6. Thermal power plant with a convective section, having a plurality of cleaning apparatuses, each cleaning apparatus including:

a holder, a lance with a fluid distributing device, a first outer feed tube, a first inner feed tube, an outer return tube, an inner return tube, a second outer feed tube and a second inner feed tube, wherein the lance is drivable in a partially telescopic manner, a drive unit for a translatory movement of the lance in the holder, a first fluid conducting system with a first feed, a first return and at least one first flow path proceeding from the first feed toward the first return for cooling that cleaning apparatus, wherein a fluid can flow from the first feed via the at least one first flow path into a cylindrical annular chamber, which is defined between the first outer feed tube and the first inner feed tube on the one hand and the outer return tube and the inner return tube on the other hand, to lance a tip of the lance, wherein the fluid is deflectable in the lance tip such that the fluid enters the outer return tube and inner return tube and is directed to the first return, a second fluid conducting system with a second feed and at least one second flow path proceeding from the second feed through the second outer feed tube and the second inner feed tube toward the fluid distributing device, wherein the second outer feed tube and the second inner feed tube are arranged inside of the outer return tube and the inner return tube, and a guide, which is provided at an end-side region of the outer return tube opposite the first return and which positions the outer return tube concentrically with respect to the first inner feed tube, wherein the outer return tube is fixed on the first inner feed tube by the guide such that the outer return tube is movable at the same time as the inner feed tube, and wherein the second inner feed tube is fixed on the first inner feed tube by the outer return tube such that the second inner feed tube is movable at the same time with the first inner feed tube;

where at least one first fluid supply system and one second fluid supply system as well as a control means for the sequential operation of the cleaning apparatuses are provided.

* * * * *